United States Patent [19]

Agrawa et al.

[11] Patent Number: 4,883,519

[45] Date of Patent: Nov. 28, 1989

[54] PROCESS FOR THE PRODUCTION OF HIGH PRESSURE NITROGEN WITH SPLIT REBOIL-CONDENSING DUTY

[75] Inventors: Rakesh Agrawa, Allentown; Steven R. Auvil, Macungie; Keith B. Wilson, Allentown, all of Pa.

[73] Assignee: Air Products and Chemicals, Inc., Allentown, Pa.

[21] Appl. No.: 254,512

[22] Filed: Oct. 6, 1988

[51] Int. Cl.[4] ..... F25J 3/00

[52] U.S. Cl. ..... 62/39; 62/44

[58] Field of Search ..... 62/38, 39, 42, 44, 11, 62/36

[56] References Cited

U.S. PATENT DOCUMENTS

| | | | |
|---|---|---|---|
| 4,152,130 | 5/1979 | Theobald | 62/18 |
| 4,222,756 | 9/1980 | Thorogood | 62/13 |
| 4,400,188 | 8/1983 | Patel et al. | 62/13 |
| 4,464,188 | 8/1984 | Agrawal et al. | 62/13 |
| 4,595,405 | 6/1986 | Agrawal et al. | 62/18 |
| 4,705,548 | 11/1987 | Agrawal et al. | 62/38 |
| 4,707,994 | 11/1987 | Shenoy et al. | 62/38 |

OTHER PUBLICATIONS

Celar et al: "Flexible Process of Pressure Nitrogen and Low Pressure Oxygen Production" Ferox, National Corporation, Decin, Czechoslovakia.

*Primary Examiner*—Ronald C. Capossela

*Attorney, Agent, or Firm*—Geoffrey L. Chase; James C. Simmons; William F. Marsh

[57] ABSTRACT

A process is set forth for recovery of nitrogen from a feed gas stream, containing nitrogen and oxygen, using a cryogenic separation wherein a recycle stream having an oxygen content above, equal to or below that of the feed gas stream is recycled from the cryogenic separation to the feed gas stream with a split reboil-condenser function that would allow variation of the oxygen content of the recycle stream.

17 Claims, 2 Drawing Sheets

PROCESS FOR THE PRODUCTION OF HIGH PRESSURE NITROGEN WITH SPLIT REBOIL-CONDENSING DUTY

TECHNICAL FIELD

The present invention is directed to the cryogenic separation of nitrogen from a feed gas stream containing nitrogen and oxygen. More specifically, the present invention is directed to recovering high purity nitrogen from air using a cryogenic separation with an unexpected efficiency increase achieved by appropriate recycle of a process stream.

BACKGROUND OF THE PRIOR ART

The use of nitrogen has become increasingly important in various industrial and commercial operations. For example, liquid nitrogen is used to freeze food, in the cryogenic recycling of tires and as a source of gaseous nitrogen for inerting. Gaseous nitrogen is used in applications such as secondary oil and gas recoveries and as a blanketing gas in metal refineries, metal working operations and chemical processes. In light of the increasing importance of nitrogen in such operations, it is desirable to provide a process which is both economical and efficient for producing nitrogen in the liquid and/or gas phase.

High purity gaseous nitrogen is produced directly by well known cryogenic separation methods. U.S. Pat. No. 4,222,756 teaches a process and apparatus for producing gaseous nitrogen using multiple distillation columns and associated heat exchangers. Ruhemann and Limb, I. Chem. E. Symposium Series No. 79, page 320 (1983) advocate a preference for the use of the single distillation column instead of the typical double column for the production of gaseous nitrogen.

Liquid nitrogen is typically produced by initially producing gaseous nitrogen in a cryogenic air separation unit and subsequently treating the gaseous nitrogen in a liquefier. Modified forms of cryogenic air separation units have been developed to directly produce liquid nitrogen. U.S. Pat. No. 4,152,130 discloses a method of producing liquid oxygen and/or liquid nitrogen. This method comprises providing a substantially dry and substantially carbon dioxide-free air stream, cryogenically treating the air stream to liquefy a portion of the air stream, and subsequently feeding the air stream into a fractionation column to separate the nitrogen and oxygen and withdrawing liquid oxygen and/or nitrogen from said column.

Various process cycles using a single distillation column, with some boil-up at the bottom provided by the appropriate high pressure fluids, have also been suggested in the patent literature, for example, U.S. Pat. No. 4,400,188 and U.S. Pat. No. 4,464,188.

In U.S. Pat. No. 4,595,405 a process for the cryogenic separation of nitrogen from air is taught, wherein the cryogenic separation is conducted in a single pressure distillation column. The oxygen enriched waste gas from the cryogenic separation is rewarmed, compressed to an elevated pressure and processed through a selective membrane separation to extract oxygen from the waste stream for recovery or removal, while returning a nitrogen enriched stream to the feed air to the cryogenic separation. This process entails the additional capital outlay for compression and membrane separation.

In many of the cryogenic processes for recovery of nitrogen, the oxygen-enriched waste stream is removed from the cryogenic separation zone or distillation column and is reduced in pressure with the recovery of work in order to produce refrigeration for the feed stream being cooled for cryogenic separation. Often, there is more oxygen-enriched waste than is necessary to reduce in pressure with the recovery of work for the production of refrigeration. All of such waste cannot be processed accordingly without creating excess refrigeration. To avoid production of excess refrigeration, a portion of the waste stream is merely passed through an expansion valve, without the recovery of work, so as to minimize refrigeration production. This expansion without the recovery of work is a waste of the energy utilized to create the pressurized condition of that stream, as well as a waste of the nitrogen content of the stream.

The present invention overcomes the drawbacks of the prior art in producing high purity nitrogen using a cryogenic separation technique, wherein efficiencies are derived by the use of recycle and pressure maintenance of certain process streams as set forth below.

BRIEF SUMMARY OF THE INVENTION

The present invention is a process for the recovery of nitrogen from a feed gas stream containing nitrogen and oxygen whereby a pressurized condition is retained in a recycle process stream, comprising the steps of: compressing a feed gas stream containing nitrogen and oxygen to an elevated pressure, introducing the elevated pressure feed gas stream into a cryogenic separation zone to recover a high purity nitrogen product from said zone, and to produce an initial oxygen-enriched waste stream, introducing the initial oxygen-enriched waste stream into a first reboil-condenser zone of the cryogenic separation zone to recover an elevated pressure recycle stream and a second oxygen-enriched waste stream which is introduced to a second reboil-condenser zone to recover a final oxygen-enriched waste stream, and removing said elevated pressure recycle stream from said cryogenic separation zone, and without any intervening process steps to decrease the oxygen content of said recycle stream, recycling said stream at elevated pressure to the feed gas stream for introduction into the cryogenic separation zone.

Preferably, said feed gas stream is air.

The recycle stream can be introduced into said feed gas stream at an intermediate level of the compression of said feed gas stream.

Preferably said feed gas stream, after mixing with the recycle stream and performing further compression on the combined feed stream, is pretreated to remove water and carbon dioxide. Alternatively, said recycle stream is recompressed to said pressure of said elevated pressure feed gas stream and said recycle stream is introduced into said feed gas stream downstream of said pretreatment.

Preferably said high purity nitrogen product has a nitrogen content of at least 95%. Alternatively, said high purity nitrogen product has a nitrogen content of at least 99.5%.

Preferably, a portion of said final oxygen-enriched waste stream is let down in pressure across an expander with the recovery of work to produce refrigeration for said cryogenic separation zone.

A preferred embodiment of the present invention is a process for the recovery of nitrogen from a feed gas stream comprising air whereby a pressurized condition is retained in a recycle stream which is recycled to the feed gas stream comprising the steps of: compressing a feed gas stream to an elevated pressure, pretreating said feed gas stream to remove water and carbon dioxide therefrom, cooling the feed gas stream by heat exchange against a rewarming process stream, introducing said cooled feed gas stream into a cryogenic distillation zone, separating said feed gas stream in said distillation zone into a high purity nitrogen product and an initial oxygen-enriched waste stream having an oxygen content above that of air, introducing said initial oxygen-enriched waste stream into a first reboil-condenser zone of the cryogenic separation zone to recover an elevated pressure recycle stream and a second oxygen-enriched waste stream, introducing said second oxygen-enriched waste stream into a second reboil-condenser zone to recover a final oxygen-enriched waste stream, reducing the pressure on said final oxygen-enriched waste stream by expanding through an expander with the recovery of work to produce refrigeration, and recycling said elevated pressure recycle stream to the feed gas stream without substantial pressure reduction and without any intervening process step to decrease the oxygen content of said recycle stream.

Preferably, said cryogenic distillation zone has a single pressure state distillation column. Alternatively, the cryogenic distillation zone can have multiple pressure stages in the distillation column.

Alternatively, liquid nitrogen product can be produced from the process of the present invention either with or without gaseous nitrogen product. Additionally, the high purity nitrogen product can be rewarmed against the feed air stream. If needed, a portion of said final waste stream is bypassed around said expander and reduced in pressure without the recovery of work.

DETAILED DESCRIPTION OF THE INVENTION

The present invention is an efficient means to recover energy from the pressurized waste stream produced in a nitrogen production cryogenic separation plant. The process provides this efficiency by compressing a recycle stream of at least a part of the oxygen-enriched waste stream and mixing it with the feed gas stream to the cryogenic separation plant. This recycle stream can have a concentration of nitrogen above, at or below that of the feed gas stream. Alternatively, the recycle stream can be mixed with the feed gas stream at an intermediate stage of the feed gas compression and the combined streams further compressed to the distillation zone pressure.

For gaseous nitrogen (GAN) plants in the size range of 30–250 ton/day, both the energy costs and capital-related costs play an equally important role in the cost of the GAN. Capital considerations often prohibit the use of additional pieces of equipment that would make the process more efficient. The current prior art process of FIG. 1 produces high pressure GAN product without using an additional compressor to compress the GAN from the cold box. Most cycles using other means of refrigeration, such as an air expander, tend to produce GAN at lower pressures and require additional capital for a compressor to pressurize the GAN. Furthermore, in certain applications, such as in the electronics industry where the purity of th GAN product is of paramount importance, it is undesirable to compress the GAN product since this increases the likelihood that it will be contaminated with trace levels of impurities and particulates. The process of FIG. 1 achieves higher pressures of the GAN product by backpressuring the distillation column and by collecting the oxygen enriched waste stream from the top boiler/ condenser at elevated pressures. This waste stream is then expanded across an expander to provide the needed refrigeration for the plant. More often, a large portion of this waste stream bypasses the expander and is expanded across a valve to avoid excess refrigeration. This is an inefficient step.

Figure 2:
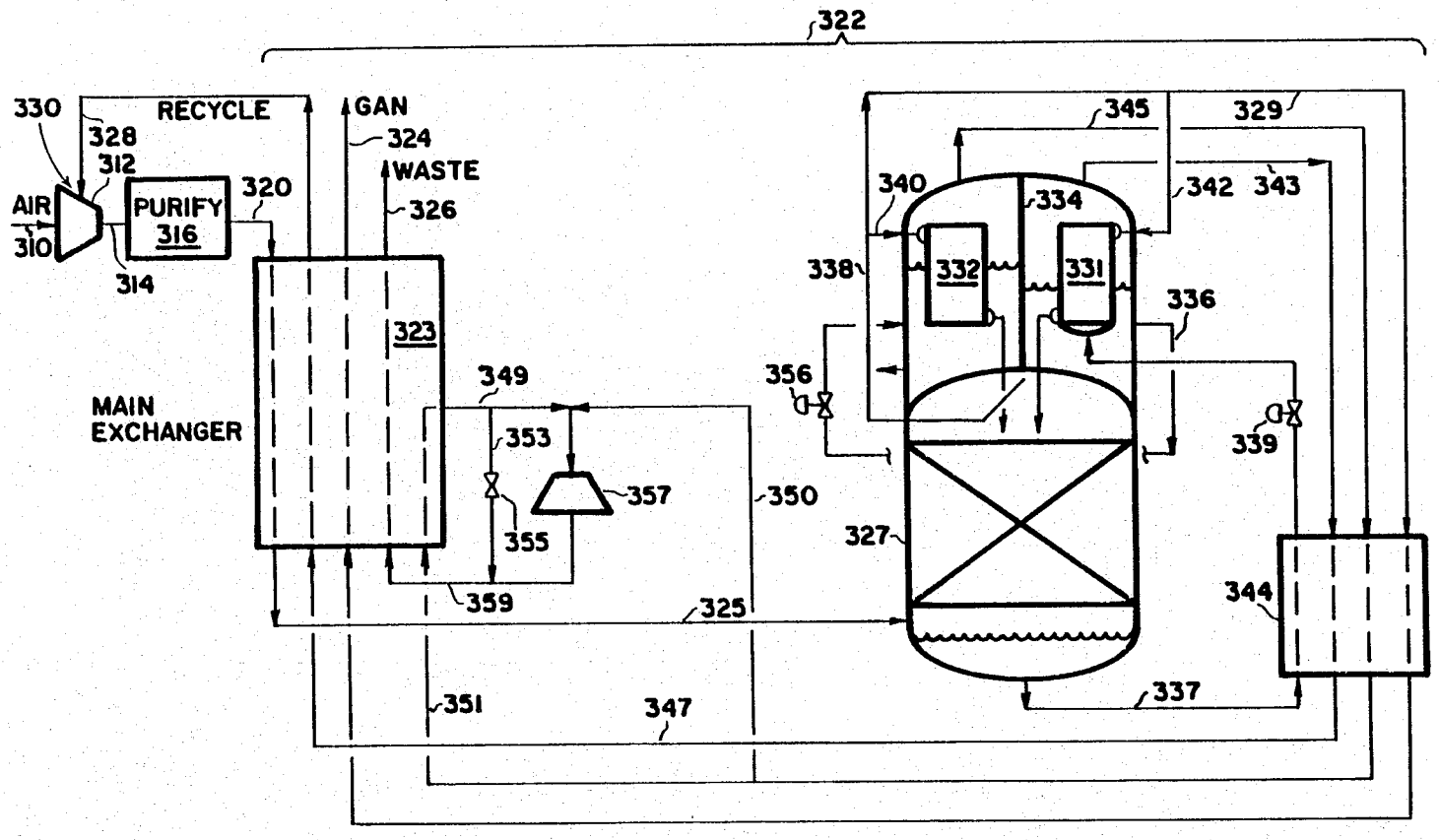
FIG. 2 is a schematic illustration of an embodiment of the present invention.

The process of FIG. 2 illustrating the present invention overcomes most of the inefficiency by boiling the initial oxygen enriched waste stream from the bottom of the distillation column in two steps. The vaporized stream from the first step is collected at a higher pressure and is warmed and fed to an intermediate stage of the main air compressor as a recycle stream. This allows, at a marginal increased cost of a heat exchanger and some associated valves, the recovery of a recycle stream at a fairly high pressure and saves significant fraction of energy in the main air compressor.

The composition and pressure of the recycle stream from the first reboiler/condenser can be varied over a wide range. Its concentration of nitrogen can be higher than, equal to or less than that in the air. Similarly its pressure can be adjusted from a few psi higher than the feed air stream at the inlet of the main air compressor to a few psi lower than the product GAN stream. This provides a great deal of flexibility in matching the pressure of the recycle stream to an intermediate stage pressure of the main air compressor. The present invention increases the energy efficiency of such plants by 8–15% with very minimal increases in capital investment.

Figure 1:
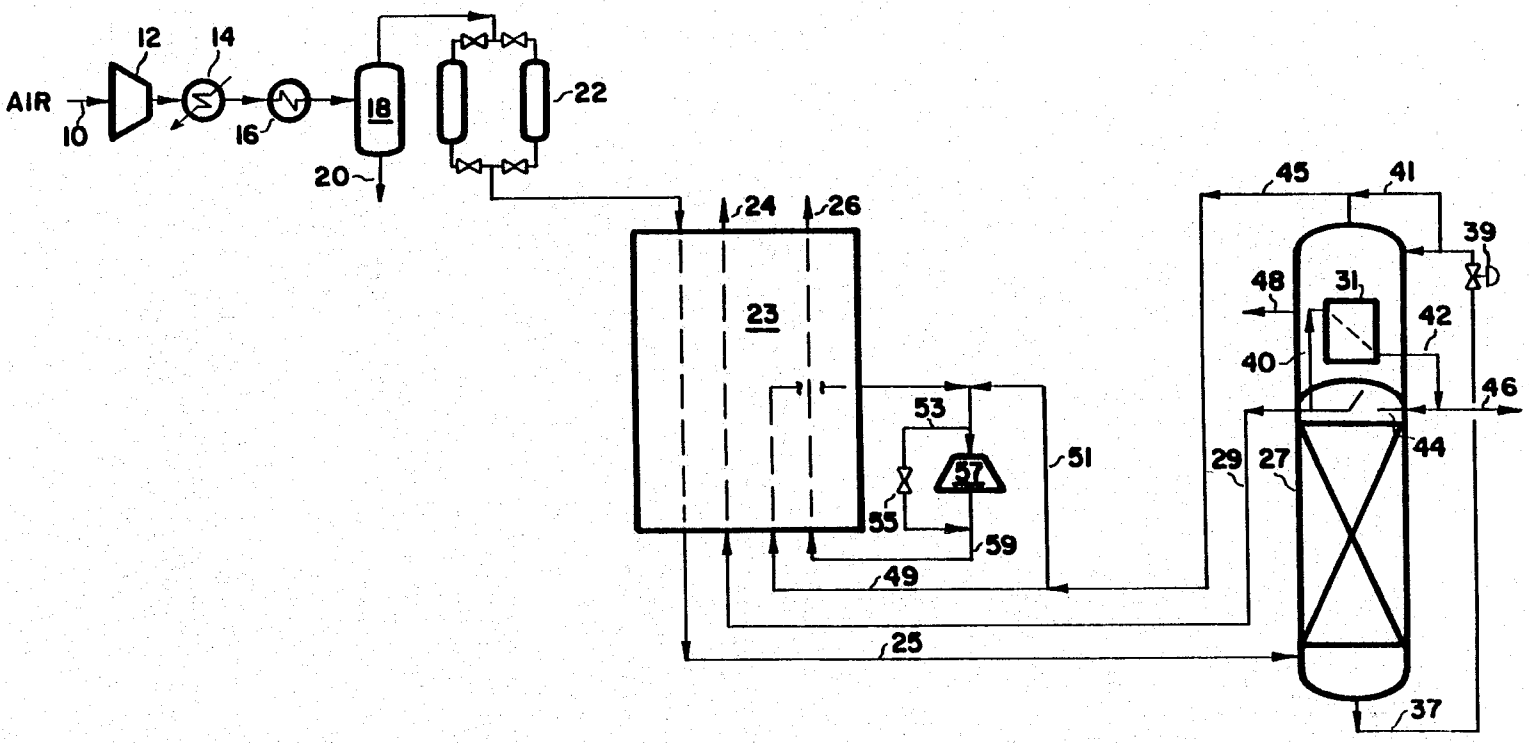
FIG. 1 PRIOR ART
FIG. 1 is a schematic illustration of a process of the prior art.

The prior art identified in FIG. 1 will be briefly described wherein air in line 10 is compressed to an elevated pressure in compressor 12 and cooled in a water fed aftercooler 14 and a refrigeration cooler 16 to remove water in line 20 of a phase separator 18. The initially dried air is then fed through switching beds 22 of a desiccant before being cooled in a main heat exchanger 23 against process streams and fed in line 25 to a single column distillation column 27. Nitrogen product is recovered in line 29 and is rewarmed in heat exchanger 23 to produce an elevated pressure gaseous nitrogen product in line 24. Some of the nitrogen from column 27 is removed in line 40 and condensed in reboiler condenser 31 against oxygen-enriched waste to recover a liquefied nitrogen in line 42 which is split into a reflux stream 44 to reflux the column 27 and potentially a liquefied nitrogen product in line 46. Oxygen-enriched liquid from the distillation column 27 is removed in line 37, reduced in pressure in valve 39, a portion of which is bypassed in line 41, and the bulk of the oxygen-enriched stream rewarms against the nitrogen in reboiler condenser 31. A certain amount of purge can be removed in line 48 to avoid undue oxygen enrichment. The rewarmed oxygen-enriched stream in line 45 is split for partial cooling in line 49 in the heat exchanger 23 and a bypass stream in line 51, both of which are recombined and passed through turbine expander 57 to recover work and produce refrigeration. A portion of the stream which is not necessary to produce refrigeration is bypassed in line 53 in valve 55 and the combined streams in line 59 are rewarmed in exchanger 23 and vented as a low pressure oxygen-enriched waste stream in line 26. Generally the stream in line 26 contains nitrogen which would be desirable to recover as product of the process and stream 26 has constituted a considerable energy loss in the amount of pressurized gas that is bypassed around the turbine expander which bypass is unnecessary for the amount of refrigeration necessary.

A preferred embodiment of the present invention is set forth in FIG. 2 wherein air in line 310 is compressed in the main air compressor 312 and after blending with recycle stream 328, the combined feed gas stream in line 314 is subject to purification of cooling and adsorption as is conventionally practiced, illustrated herein as a box 316. The clean and dry feed gas stream in line 320 is then cooled in main heat exchanger 323 against process, recycle and product streams. The cryogenically cooled feed gas stream in line 325 is then introduced into the distillation column 327. The distillation column 327 is fabricated of appropriate design such as multi-tiered distillation trays and rectifies the feed gas stream into a nitrogen-enriched overhead phase and an initial oxygen-enriched liquid phase settling at the base of the column. The initial oxygen-enriched stream in line 337 is cooled in heat exchanger 344 against process streams and is reduced in pressure through valve 339 before being introduced into the first of two reboiler-condensers 331 of preferably a once-through heat exchange-type wherein the initial oxygen-enriched liquid boils against condensing nitrogen to result in a recycle stream in line 343 which is rewarmed in heat exchanger 344 and as a stream in line 347 is further rewarmed in main heat exchanger 323 before being recycled in line 328 to an intermediate pressure stage 330 of the main air compressor 312.

A portion of the oxygen-enriched liquid surrounding the first reboiler-condenser 331 is removed as a second oxygen-enriched waste stream in line 336, reduced in pressure by valve 356 and introduced into the overhead of the distillation column 327, surrounding the second reboiler-condenser 332, which is physically isolated from the first reboiler condenser 331 by an appropriate partition 334. The further oxygen-enriched liquid is boiled against condensing nitrogen in reboiler-condenser 332 and a final oxygen-enriched gas in line 345 is removed for rewarming in heat exchanger 344 and a portion is introduced into main heat exchanger 323 as a stream in line 351. Another portion in line 350 bypasses the main heat exchanger. The portion of the final oxygen-enriched waste stream after rewarming partially is removed in line 349, combined with the stream in line 350 and expanded through a workloaded turbine expander 357 to provide a cooled stream in line 359. A portion of the waste stream in line 349 may be bypassed around the expander 357 in line 353 and reduced in pressure through valve 355. The stream in line 359 produces the refrigeration for the cryogenic process by rewarming in main heat exchanger 323 against incoming feed, after which it is vented as a waste stream in line 326 or potentially utilized as a low purity oxygen product or for adsorbent regeneration.

Nitrogen in a gaseous form is removed from the distillation column 327 in line 338. A portion of the nitrogen stream is split out in line 340 for condensation against boiling oxygen-enriched liquid in reboiler-condenser 332 before being returned as a liquid nitrogen to reflux the distillation column 327. A further portion of the nitrogen-enriched gas is removed in line 342 and is likewise condensed against boiling oxygen-enriched liquid in reboiler-condenser 331 providing nitrogen-enriched reflux to the distillation column 327. The remaining nitrogen-enriched gaseous stream in line 329 is rewarmed in heat exchanger 344 against process streams and further rewarmed in main heat exchanger 323 against the feed gas stream before being removed as product in line 324. The distillation column 327, the heat exchangers 323 and 344 and the expander 357 all constitute a cryogenic separation zone 322.

Optionally, the nitrogen streams condensed in the two reboiler-condensers may not be of the same composition. For example, a nitrogen-enriched vapor stream may be withdrawn from any tray below the top tray and condensed in the first reboiler-condenser. After condensation, this stream can be returned at a suitable tray as reflux. This arrangement will allow the collection of the recycle stream at even higher pressure.

In order to demonstrate the value of performing a recycle to the feed air stream, the following comparison of the prior art without recycle is made with the preferred embodiment of the present invention which implements such a recycle.

Calculations were done to produce 87 T/D of GAN at 115 psia and 1.7 T/D of LIN. The ambient conditions used were 14.7 psia, 70° F. and 50% relative humidity. Some of the pertinent results are summarized in Table 1. For the proposed process of the present invention, calculations were done so that the nitrogen content of the vaporized recycle stream from the first reboiler/condenser to be recycled was same as in air. This allowed the nitrogen content in the feed to the cryogenic separation zone to be unchanged and only a negligible change in the concentrations of oxygen and argon to occur. The pressure of the vaporized recycle stream in the first reboiler/condenser was kept at 70 psia leading to the recycle stream pressure at the main heat exchanger warm end of 68 psia. The flow of the recycle stream was 94 lbmoles/hr. This reduced the expander bypass flow from 203 lbmoles/hr for the prior art process of FIG. 1 to about 95–100 lbmoles/hr for the embodiment of the present invention in FIG. 2. The power consumed in the present invention is only 90% of the currently used prior art process.

If the pressure of the boiling stream in the first reboiler/condenser is increased then the flow rate of the recycled stream would decrease but its nitrogen concentration will be higher than that in air. Conversely, a decrease in pressure will allow to increase the flow rate of the recycle stream with nitrogen cncentration lower than in air. The flow rate of the recycle stream can be increased until the expander bypass flow becomes negligible. This case with increased recycle flow can lead to more energy savings than the case shown in Table 1. For this case, however, the concentration of oxygen in the feed to the cryogenic separation zone would be higher than that in air.

In summary, the use of an additional reboiler/condenser provides an economical method to reduce the energy consumption of the process by recovering a pressurized stream which is recycled to an intermediate stage of the main air compressor. This additional reboiler/condenser also gives a flexibility in matching the pressure of the recycle stream with the intermediate stage pressure of the main air compressor. This makes the design and operation of the plant much easier. The proposed process requires minimal additional capital cost and provides high pressure GAN product efficiently without the use of a product compressor.

TABLE 1

| Product: 87 T/D GAN at 115 psia 1.7 T/D LIN | PRIOR ART PROCESS | PRESENT INVENTION |
|---|---|---|
| Nitrogen in the Recycle Stream (%) | — | 78.1 |
| Oxygen in Waste Stream (%) | 35.6 | 40.7 |
| Recycle Stream Pressure (psia) | — | 68 |
| Recycle Steam Flow (lbmoles/hr) | — | 94 |
| Feed Air Flow at MAC* Inlet (lbmoles/hr) | 639 | 545 |
| Relative Power | 1.0 | 0.90 |

*main air compressor

The prior art processes which fail to use a recycle stream are a tradeoff between capital and energy costs. In a plant size in the range of 30 to 250 T/D of nitrogen contained in the product gas, any process is designed to minimize the number of equipment items of significant capital cost. As a result, in order to produce high pressure, gaseous nitrogen product, no gaseous nitrogen compressor is used. Also, in certain applications, due to the possibility of contamination of the gaseous nitrogen, it is not advisable to use a product compressor on ultra high purity nitrogen from the cryogenic separation zone. Either of these considerations leads to a process with significant energy losses, since a substantial amount of oxygen-enriched waste gas must be expanded across a bypass valve, to the exclusion of any recycle without substantial pressure reduction. In contrast, the present invention provides a scheme to limit the amount of gas expanded across this valve, without significant additional capital requirements, such as the membrane used in the prior art, which nitrogen enriches the waste which it recycles. Instead, the present invention is designed to take a significant fraction of an initial oxygen-enriched waste gas out of the cryogenic separation zone at a high pressure and mixes this gas which may or may not be oxygen-enriched with feed gas stream at a suitable stage either in the main feed gas compressor or downstream of the feed gas stream pretreatment zone. This allows the process of the present invention to take advantage of reduced power requirements, lower capital costs, and increased recovery in comparison to the prior art.

The scope of the present invention should be ascertained from the claims which follow:

We claim:

1. A process for the recovery of nitrogen from a feed gas stream containing nitrogen and oxygen whereby a pressurized condition is retained in a recycle process stream comprising the steps of:

(a) compressing a feed gas stream containing nitrogen and oxygen to an elevated pressure;

(b) introducing the elevated pressure feed gas stream into a cryogenic separation zone to recover a high purity nitrogen product from said zone and to produce an initial oxygen-enriched waste stream;

(c) introducing the initial oxygen-enriched waste stream into a first reboil-condenser zone of the cryogenic separation zone to recover an elevated pressure recycle stream and a second reboil-condenser zone to recover a final oxygen-enriched waste stream; and (d) removing said elevated pressure recycle stream from said cryogenic separation zone and while at least maintaining the oxygen content of said recycle stream, recycling said stream at elevated pressure to the feed gas stream for introduction into the cryogenic separation zone.

2. The process of claim 1 wherein said feed gas stream is air.

3. The process of claim 1 wherein said recycle stream is introduced into said feed gas stream at an intermediate level of the compression of said feed gas stream.

4. The process of claim 1 wherein said elevated pressure feed gas stream is pretreated to remove water, carbon dioxide and other contaminants.

5. The process of claim 4 wherein said recycle stream is recompressed to said pressure of said elevated pressure feed gas stream and said recycle stream is introduced into said feed gas stream downstream of said pretreatment.

6. The process of claim 1 wherein said high purity nitrogen product has a nitrogen content of at least 95% nitrogen by volume.

7. The process of claim 1 wherein said high purity nitrogen product has a nitrogen content of at least 99.5% nitrogen by volume.

8. The process of claim 1 wherein a portion of said final oxygen-enriched waste stream is expanded through an expander to extract work and produce refrigeration for said cryogenic separation zone.

9. A process for the recovery of nitrogen from a feed gas stream comprising air whereby a pressurized condition is retained in a recycle stream which is recycled to the feed gas stream, comprising the steps of:

(a) comprising a feed gas stream to an elevated pressure;

(b) pretreating said feed gas stream to remove water and carbon dioxide therefrom;

(c) cooling the feed gas stream by heat exchange against a rewarming process stream;

(d) introducing said cooled feed gas stream into a cryogenic distillation zone;

(e) separating said feed gas stream in said distillation zone into a high purity nitrogen product and an initial oxygen-enriched waste stream having an oxygen content above that of air;

(f) introducing said initial oxygen-enriched waste stream into a first reboil-condenser zone of the cryogenic separation zone to recover an elevated pressure recycle stream and a second oxygen-enriched waste stream;

(g) introducing said second oxygen-enriched waste stream into a second reboil-condenser zone to recover a final oxygen-enriched waste stream;

(h) reducing the pressure on at least a portion of said final oxygen-enriched waste stream by expanding through an expander with the recovery of work to produce refrigeration for step (c); and (i) recycling said elevated pressure recycle stream to the feed gas stream while substantially maintaining its pressure and at least maintaining the oxygen content of said recycle stream.

10. The process of claim 9 wherein said recycle stream is introduced into said feed gas stream at an intermediate level of the compression of said feed air stream.

11. The process of claim 9 wherein said recycle stream is recompressed to said elevated pressure of said feed gas stream and said second portion is introduced into said feed gas stream downstream of said pretreatment.

12. The process of claim 9 wherein said cryogenic distillation zone has a single pressure stage.

13. The process of claim 9 wherein said high purity nitrogen product has a nitrogen content of at least 95% nitrogen by volume.

14. The process of claim 9 wherein said high purity nitrogen product has a nitrogen content of at least 99.5% nitrogen by volume.

15. The process of claim 9 wherein a liquid nitrogen product is produced.

16. The process of claim 9 wherein the high purity nitrogen product is rewarmed against the feed gas stream.

17. The process of claim 9 wherein a portion of said final waste stream is bypassed around said expander and reduced in pressure without the recovery of work.

* * * * *